US011331531B2

(12) United States Patent
Banfield et al.

(10) Patent No.: US 11,331,531 B2
(45) Date of Patent: May 17, 2022

(54) MIND TO MUSCLE CONNECTION TRAINING

(71) Applicants: Jordan Banfield, Calgary (CA); Josh Banfield, Calgary (CA)

(72) Inventors: Jordan Banfield, Calgary (CA); Josh Banfield, Calgary (CA)

( * ) Notice: Subject to any disclaimer, the term of this patent is extended or adjusted under 35 U.S.C. 154(b) by 0 days.

(21) Appl. No.: 16/129,662

(22) Filed: Sep. 12, 2018

(65) Prior Publication Data

US 2020/0078631 A1 Mar. 12, 2020

(51) Int. Cl.
*A63B 21/075* (2006.01)
*A63B 21/072* (2006.01)

(52) U.S. Cl.
CPC ..... *A63B 21/075* (2013.01); *A63B 21/0724* (2013.01); *A63B 21/0726* (2013.01)

(58) Field of Classification Search
CPC ..... A63B 21/0004; A63B 21/00058; A63B 21/00061; A63B 21/00065; A63B 21/00076; A63B 21/062; A63B 21/0622; A63B 21/0624; A63B 21/0626; A63B 21/0628; A63B 21/063; A63B 21/0632; A63B 21/072; A63B 21/0722; A63B 21/0724; A63B 21/0726; A63B 21/0728; A63B 21/075; A63B 21/4023; A63B 21/4041; A63B 21/4043; A63B 21/4045; A63B 71/0009; A63B 71/0619; A63B 71/0622; A63B 2071/0018; A63B 2071/0027; A63B 2071/0647; A63B 2244/09; A63B 21/0601; A63B 21/0602; A63B 21/0603; A63B 21/0604; A63B 21/0605; A63B 21/0607
USPC ..... 482/106, 108
See application file for complete search history.

(56) References Cited

U.S. PATENT DOCUMENTS 259,752 A * 6/1882 Fisher, Jr. ..... A63B 21/075 482/108
318,078 A * 5/1885 Bailey ..... A63B 21/075 482/108
416,565 A * 12/1889 Campbell ..... A63B 21/075 482/108
466,276 A * 12/1891 Le Garde ..... A63B 21/075 482/108
484,352 A * 10/1892 Ayton ..... A63B 21/075 482/108
675,314 A * 5/1901 Abenheim ..... A63B 21/075 482/108
702,356 A * 6/1902 Calvert ..... A63B 21/0724 482/106
708,313 A * 9/1902 Buck ..... A63B 21/075 482/108
793,101 A * 6/1905 Schmidt ..... A61H 15/0092 482/108

(Continued)

*Primary Examiner* — Gary D Urbiel Goldner
(74) *Attorney, Agent, or Firm* — David W Barman

(57) ABSTRACT

A training and conditioning system including: a training and conditioning system assembly including: a plurality of weights; and a training manual. The training and conditioning system has a training and conditioning assembly; wherein each of the weights are configured to be manipulated by a user-athlete according to the training manual. The plurality of weights are unmarked as to how much each weighs so as to train a user-athlete mentally and physically to accomplish training regardless of weight randomly lifted.

3 Claims, 5 Drawing Sheets

(56) References Cited

U.S. PATENT DOCUMENTS 980,025 A * 12/1910 Titus ..... A63B 21/075 482/108
983,372 A * 2/1911 Johnson ..... A63B 21/0724 482/106
984,721 A * 2/1911 Titus ..... A63B 21/075 482/108
990,791 A * 4/1911 Whitley ..... A63B 21/0724 482/106
1,019,584 A * 3/1912 Balston ..... A63B 21/0602 482/108
1,316,683 A * 9/1919 Calvert ..... A63B 21/072 482/93
1,326,013 A * 12/1919 Ayd ..... A63B 21/075 482/108
1,524,888 A * 2/1925 Schuurjohn ..... A63B 21/0605 482/108
3,171,652 A * 3/1965 Newman ..... A63B 21/0724 482/106
3,226,117 A * 12/1965 Walklet ..... A63B 21/0724 482/106
3,482,834 A * 12/1969 James, Jr. ..... A63B 21/0604 482/108
4,431,185 A * 2/1984 Cisneros ..... A63B 71/0036 482/93
4,482,151 A * 11/1984 Zwilling ..... A63B 21/0605 482/106
6,027,428 A * 2/2000 Thomas ..... A63B 22/00 434/319
6,216,535 B1 * 4/2001 Schapmire ..... A61B 5/22 73/379.08
2004/0063553 A1 * 4/2004 Viscount ..... A63B 21/072 482/107
2005/0187042 A1 * 8/2005 Rugh ..... A63B 71/0672 473/415
2007/0010381 A1 * 1/2007 Black ..... A63B 21/4029 482/130
2020/0047020 A1 * 2/2020 Harms ..... A63B 21/0724

* cited by examiner

MIND TO MUSCLE CONNECTION TRAINING

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of exercise devices, of existing art and more specifically relates to exercise devices, including monitors exercise parameter, having weight feature (e.g., dumbbell, etc.), handheld bar with weight at each end (e.g., barbell, dumbbell, etc.) or component thereof.

RELATED ART

Fitness is essential to a healthy lifestyle. Exercise is one of the most effective ways to strengthen the body and improve mental health. A healthy body requires a healthy mind. Many strength train at a gym or at home, while others partake in circuit training, crossfit or body-building, which focuses mainly on the amount of weight or resistance the user-athlete is utilizing as part of their workout regimen. Increasing weight or resistance can provide overall physical strength and increase muscle mass, however, mental strength may suffer if the amount of weight or resistance is too high or too low resulting in frustration, discouragement and disappointment. Weight training and conditioning for a complete mind to muscle connection is needed.

U.S. Pat. No. 6,216,535 to Darrell William Schapmire relates to a lever arm for testing consistency of effort during a lifting assessment having a plurality of measurement points at intervals along the length of the device. The lever arm pivots on a fulcrum located at the distal end of the device. The fulcrum consists of a rod which is supported in a horizontal position by a plurality of bearing boxes affixed to the distal end of the lever arm and a plurality of bearing boxes affixed to a base which is secured to, or rests on, a surface. This arrangement allows the lever arm to pivot in an arc when the proximal end of the device is lifted by the test subject. Workloads are applied to the lever arm and secured at said measurement points with a weight retaining assembly. Said weight retaining assembly contains a roller bar to which a plurality of barbell weighs can be affixed. At the clinician's option, simultaneous use of more than one weight retaining assembly can be employed during a test protocol as a "distraction testing" technique in assessing validity of effort. A clinician regulates the height of a subject-held handle plate by means of an adjustable chain linking system, adjusting the length of said linking system to the anthropomorphic requirements of the subject. The adjustable chain linking system connects said handle plate with the proximal end of the invention and the center of said handle plate. Using a system that includes 60 barbells of various weights and two weight retaining apparatuses, more than 1.5 million combinations of workloads are mathematically possible in a two-trial protocol. Thus, using a multiple trial protocol, it is possible to assess consistency of effort during a functional test for lifting capacity. The amount of weight lifted by a subject can be determined by referring to a table provided with the equipment a rotating and locking clip for a portable electronic device. The described rotating and locking clip for a portable device is a locking belt attachment assembly for an electronics device that allows the electronic device to be attached to a person's belt and locks the electronic device into a vertical position, thus preventing rotation while the electronic device is on the person's belt. The locking belt attachment assembly employs two pieces: a clip and a cleat. An attachment piece of the cleat is designed to be selectively inserted into a slot on the best clip, but once fully inserted into the slot, the attachment post may rotate. For the attachment post to be insertable into the slot, the electronic device is rotated to a 90-degree angle from the clip, positioning the attachment post in an insertable position relative to the slot. Once the attachment post is fully inserted into the slot, the electronic device is rotated 90-degrees to vertical and a snap lock feature on the belt clip interfaces with a snap lock mating feature on the cleat, locking the electronic device into its vertical position. To remove the electronic device, a rotating force is applied that disengages the snap lock feature and the electronic device is rotated 90-degrees to a horizontal position and the attachment post is removed from the slot, releasing the cleat from the clip.

SUMMARY OF THE INVENTION

In view of the foregoing disadvantages inherent in the known field of exercise devices, of existing art and more specifically relates to exercise devices, including monitors exercise parameter, having weight feature (e.g., dumbbell, etc.), handheld bar with weight at each end (e.g., barbell, dumbbell, etc.), the present disclosure provides a novel method of weight training and conditioning with a set of unmarked weights. The general purpose of the present disclosure, which will be described subsequently in greater detail, is to provide weight training and conditioning for a complete mind to muscle connection.

A training and conditioning system is disclosed herein comprising: a training and conditioning system assembly including: a plurality of weights; and a training manual. The training and conditioning system comprises the training and conditioning assembly; wherein each of the weights are configured to be manipulated by a user-athlete according to the training manual. The plurality of weights are unmarked as to how much each weighs so as to train a user-athlete mentally and physically to accomplish training regardless of weight randomly lifted.

A method of use for the training and conditioning system is also disclosed herein comprising the steps of: providing a set of unmarked weights; providing an exercise regimen to follow; and selecting a set of the unmarked weights to exercise with for resistance.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a weight training and conditioning system, constructed and operative according to the teachings of the present disclosure.

DETAILED DESCRIPTION

As discussed above, embodiments of the present disclosure relate to field of exercise devices, of existing art and more specifically relates to exercise devices, including monitors exercise parameter, having weight feature (e.g., dumbbell, etc.), handheld bar with weight at each end (e.g., barbell, dumbbell, etc.) as used to improve weight training and conditioning for a complete mind to muscle connection.

Referring now more specifically to the drawings by numerals of reference, there is shown in FIGS. 1-5, various views and flowcharts of a weight training and conditioning for a complete mind to muscle connection system 100.

Figure 1:
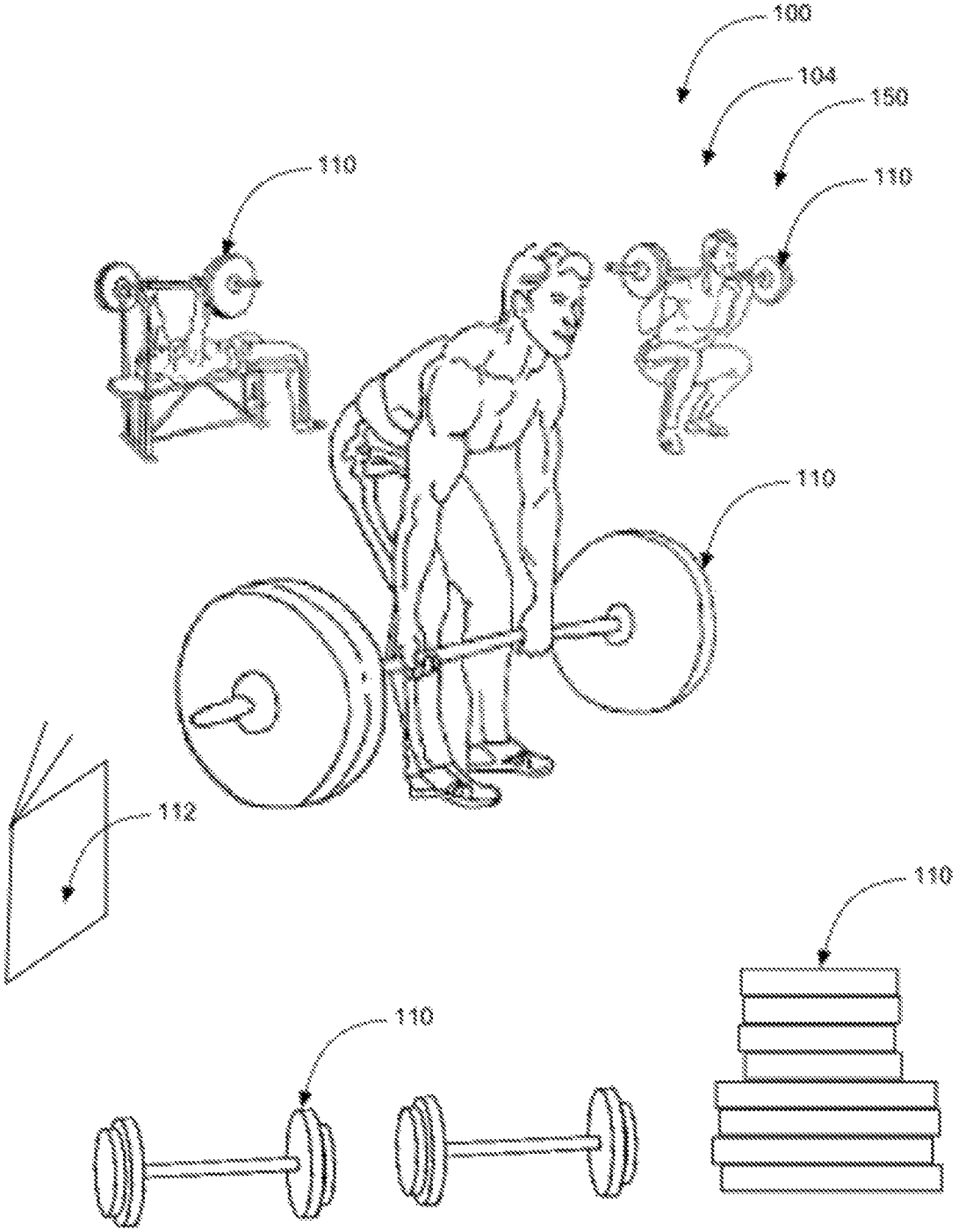
FIG. 1 is a perspective view of the weight training and conditioning system during an 'in-use' condition, according to an embodiment of the disclosure.
Figure 2:
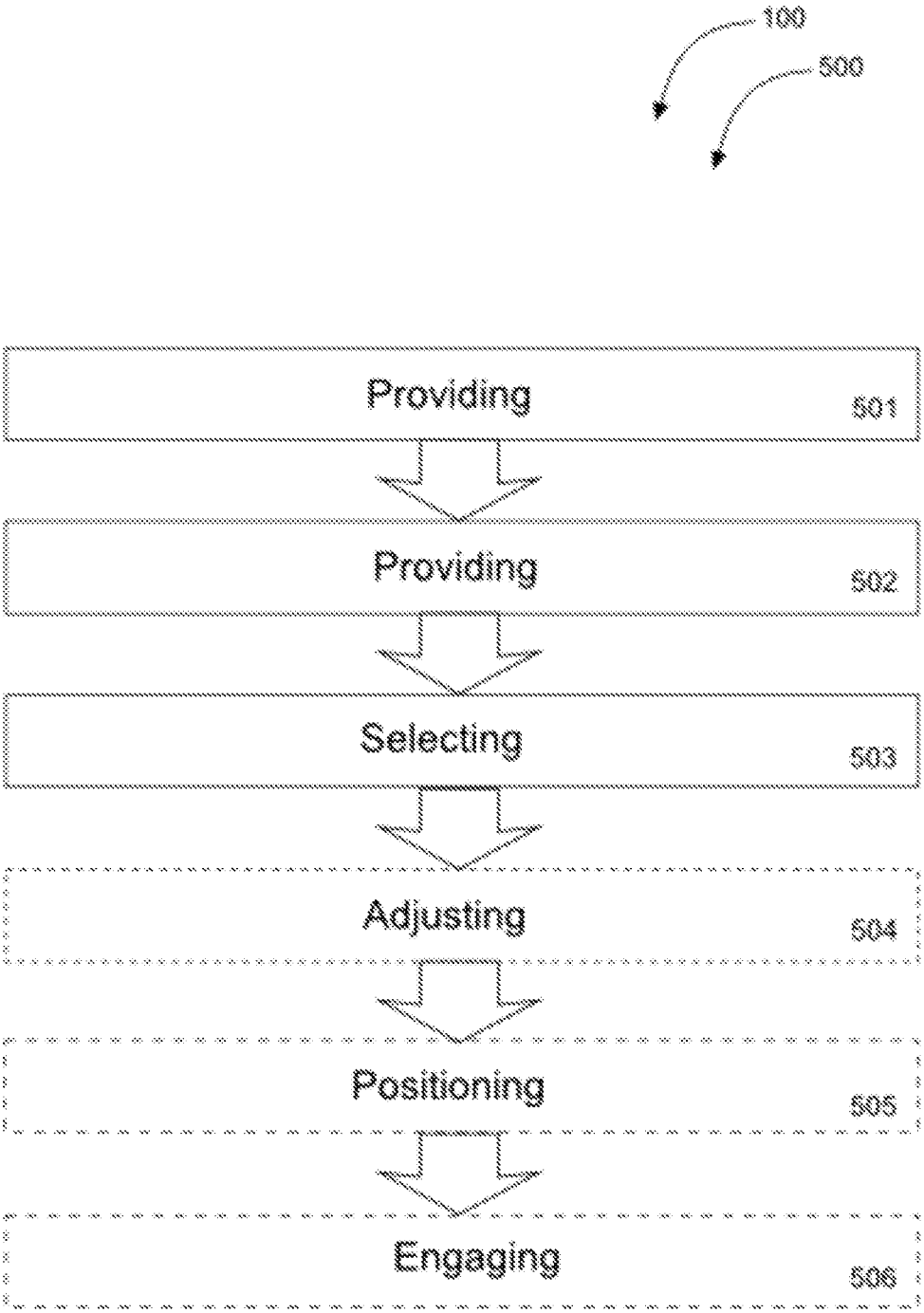
FIG. 2 is a flowchart of a method of use for the weight training and conditioning system of FIG. 1, according to an embodiment of the present disclosure.
Figure 3:
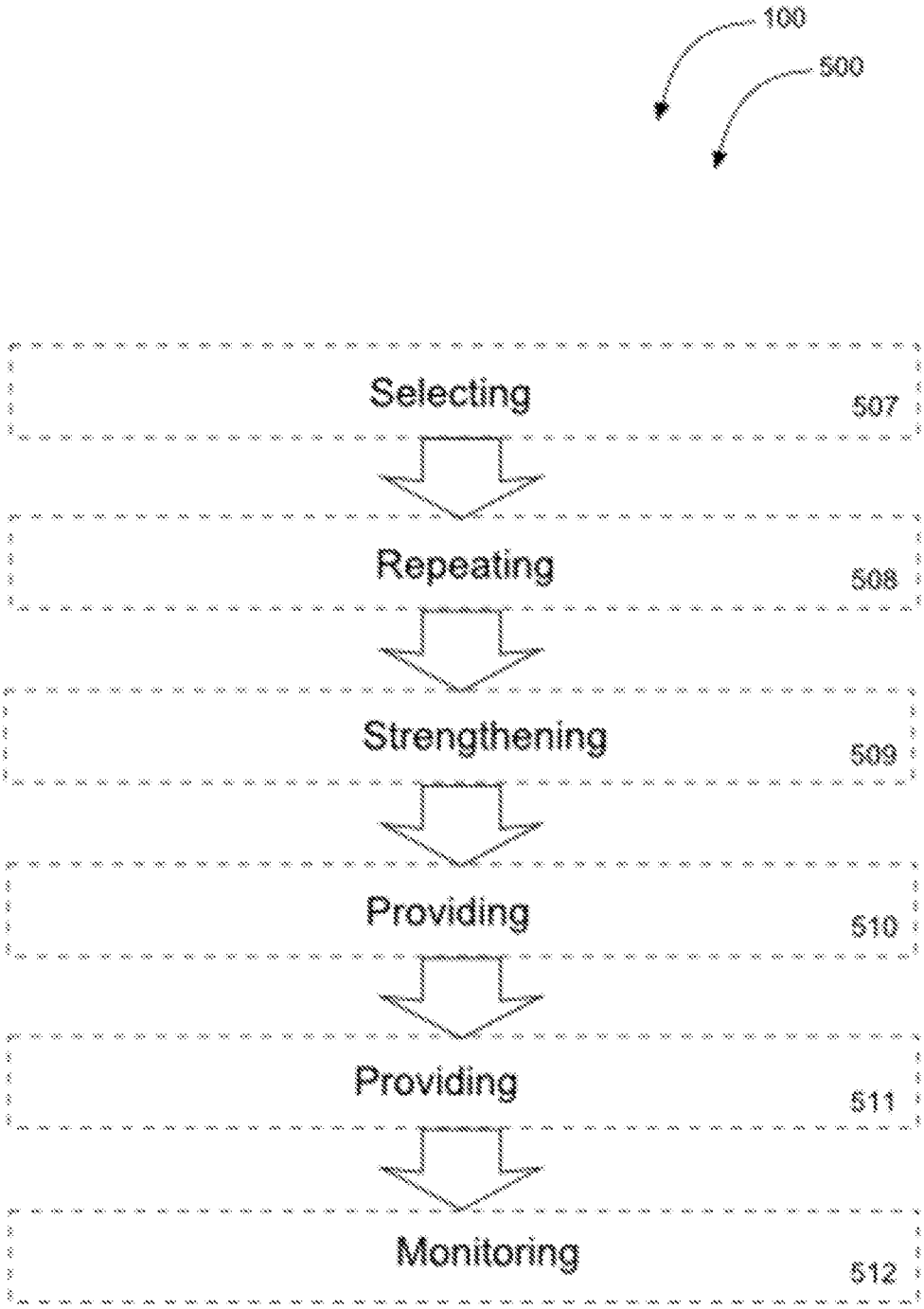
FIG. 3 is a flowchart for use of the weight training and conditioning system of FIG. 1, according to an embodiment of the present disclosure.
Figure 4:
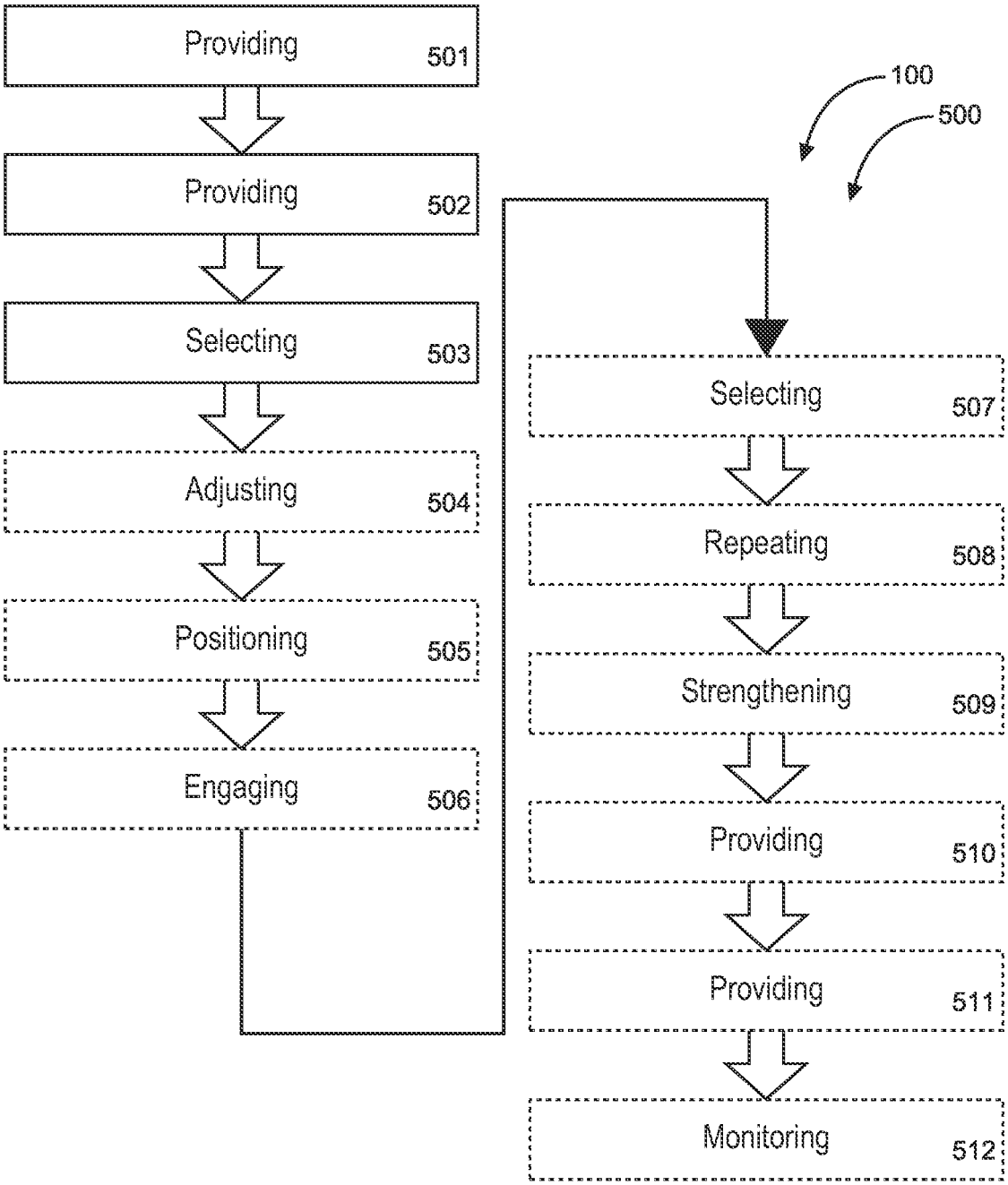
FIG. 4 is another flowchart for use of the weight training and conditioning system of FIG. 1, according to an embodiment of the present disclosure.
Figure 5:
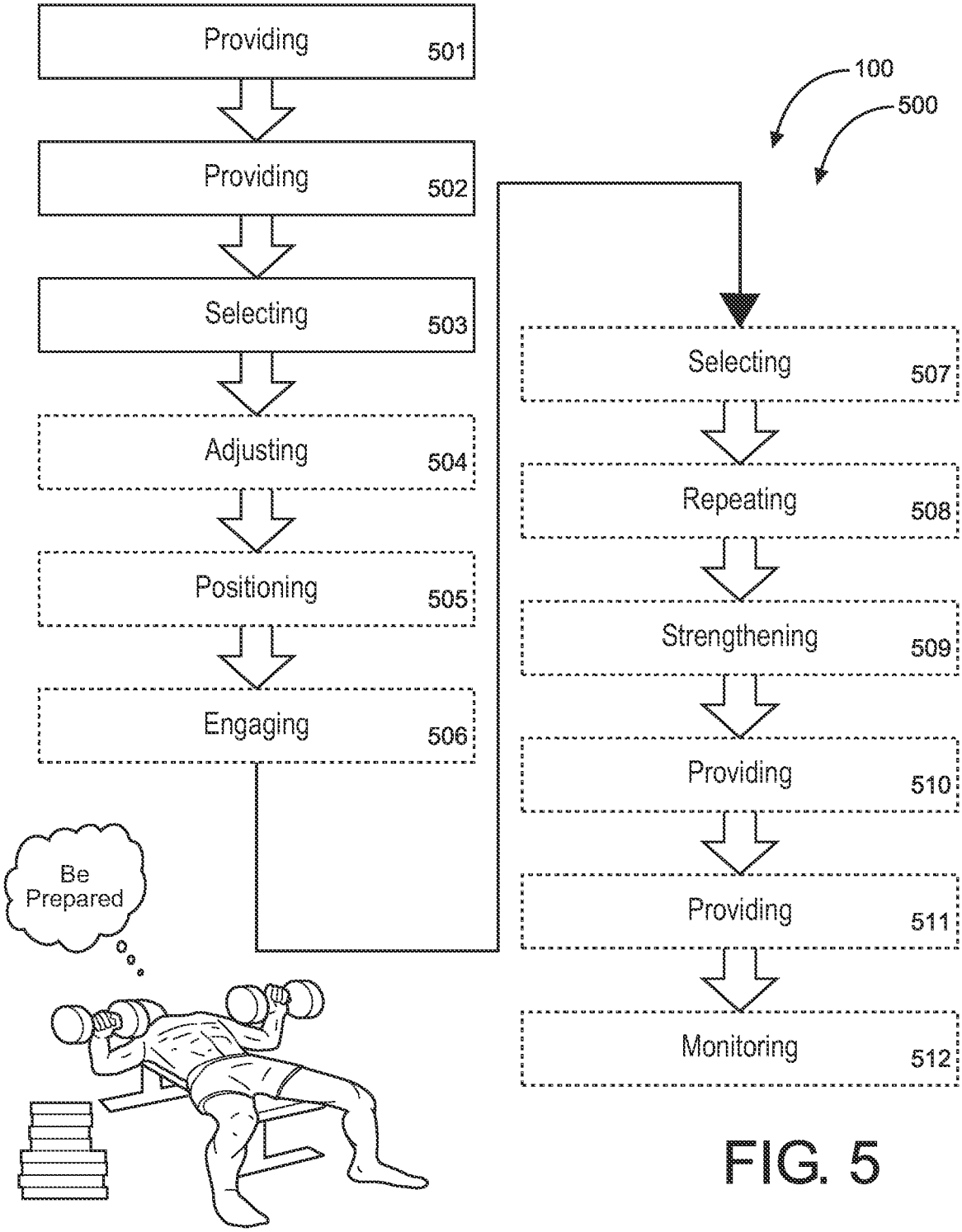
FIG. 5 is a flowchart for the method of use for the weight training and conditioning system of FIG. 1, according to an embodiment of the present disclosure. The various embodiments of the present invention will hereinafter be described in conjunction with the appended drawings, wherein like designations denote like elements.

FIG. 1 shows a weight training and conditioning for a complete mind to muscle connection system 100, according to an embodiment of the present disclosure. Here, the weight training and conditioning for a complete mind to muscle connection system 100 may be beneficial for use by a user-athlete to train mentally and physically to accomplish training regardless of the weight that is randomly lifted, as shown in in-use condition 150. As illustrated, the weight training and conditioning for a complete mind to muscle connection system 100 may comprise: a weight training and conditioning for a complete mind to muscle connection assembly 104 including: a plurality of weights 110; and a training manual 112. The weight training and conditioning for a complete mind to muscle connection 100 comprises the weight training and conditioning for a complete mind to muscle connection assembly 104. The weight training and conditioning for a complete mind to muscle connection assembly 104 comprises in function combination the plurality of weights 110, and the training manual 112. The plurality of weights 110 is configured to be manipulated by a user-athlete according to the training manual 112. Manipulation of the weights may be conducted via raising and lowering, or pushing and pulling, depending on the nature of the weights and weight equipment in use and the exercises being conducted.

The plurality of weights 110 are visually unmarked as to how much each weighs so as to train the user-athlete mentally and physically to accomplish the training regimen regardless of the weight that is randomly lifted. This is especially important for user-athletes that participate in sports requiring explosive movements, as in football and basketball, or where unknown bursts of energy may be needed at various points to win, for example running a final sprint in a marathon or the like. Also, in order to assist in conducting the training program, each weight may have a non-obvious marking, such as a raised dot pattern similar to Braille in a specific location on an interior edge, which may be used by a coach or trainer to select the weight for the user athlete to use.

The training and conditioning system comprises: a plurality of weights 110; a training manual 112. Each of the plurality of weights 110 are configured to be manipulated by a user-athlete according to the training manual 112, each of the plurality of weights 110 being unmarked as to how much each weighs so as to train said user-athlete mentally and physically to accomplish the training regardless of what weight is randomly lifted. The plurality of weights 110 may be free-standing and comprise dumbbells (of iron, rubber-coated iron, chromed iron, plastics, filled plastics, composites, lead or similar materials) or non-dumbbell versions (again formed from similar materials) may be used. All weights 110 in a set need not be made of same material as long as each provides a similar unmarked appearance so as not to be distinguishable by the user athlete.

Referring now to FIGS. 2-5 showing various views of the method of use of the weight training and conditioning for a complete mind to muscle connection system 100 of FIG. 1, according to an embodiment of the present disclosure.

As illustrated, the method of use for the weight training and conditioning for a complete mind to muscle connection system 100 comprises the steps of: step one 501 providing a set of unmarked weights; step two 502 providing an exercise regimen to follow; and step three 503 selecting a set of said unmarked weights for resistance; step four 504 adjusting adequate weight resistance of set of said unmarked weights; step five 505 positioning body and posture alignment to support set of said unmarked weights; step six 506 engaging muscles and joints of said body by counterforce motion of raising and lowering and pushing and pulling the set of said unmarked weights; step seven 507 selecting multiple weight combinations of set of said unmarked weights; step eight 508 repeating repetition of said exercise regimen; step nine 509 strengthening said muscles and said joints of said body with set of said unmarked weights; step ten 510 providing mind to muscle connection training with set of said unmarked weights; step eleven 511 providing mind relaxation independent of weight selection with set of said unmarked weights; and step twelve 512 monitoring and analyzing said exercise regimen. The exercise regimen is devoted to strength endurance; cardiovascular endurance; may be concentrated on training for sprinting sports; training for explosive sports, to building muscle mass; to endurance benefits at any age and to positive effects on brain function and memory; and reducing stress.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A training and conditioning system comprising:

a plurality of weights, each of said plurality of weights being unmarked as to a numerical weight thereof except for a raised dot pattern in a specific location on an interior edge thereof representing said numerical weight; and a training manual;

wherein each of said plurality of weights is configured to be manipulated by a user-athlete according to said training manual; and wherein said raised dot pattern is configured to enable a coach or trainer to select at least one of said plurality of weights for said user-athlete to manipulate for training said user-athlete mentally and physically to accomplish said training regardless of which of said at least one of said plurality of weights is randomly lifted.

2. The training and conditioning system of claim 1 wherein said plurality of weights are free-standing.

3. The training and conditioning system of claim 1 wherein said plurality of weights comprise dumbbells.

* * * * *